US007775775B2

(12) United States Patent
Cho et al.

(10) Patent No.: US 7,775,775 B2
(45) Date of Patent: Aug. 17, 2010

(54) TWO STAGE RECIPROCATING COMPRESSOR AND REFRIGERATOR HAVING THE SAME

(75) Inventors: Sung-Man Cho, Seoul (KR); Jeong-Woo Kim, Seoul (KR); Eon-Pyo Hong, Seoul (KR); Jung-Sik Park, Seoul (KR)

(73) Assignee: LG Electronics Inc., Seoul (KR)

( * ) Notice: Subject to any disclaimer, the term of this patent is extended or adjusted under 35 U.S.C. 154(b) by 249 days.

(21) Appl. No.: 12/049,529

(22) Filed: Mar. 17, 2008

(65) Prior Publication Data

US 2008/0240937 A1 Oct. 2, 2008

(30) Foreign Application Priority Data

Mar. 27, 2007 (KR) ..... 10-2007-0029856
Jun. 13, 2007 (KR) ..... 10-2007-0057883

(51) Int. Cl.
*F04B 17/04* (2006.01)

(52) U.S. Cl. ..... 417/244; 417/417; 417/254

(58) Field of Classification Search ..... 417/417, 417/328, 363, 523, 244, 254, 260, 262, 265
See application file for complete search history.

(56) References Cited

U.S. PATENT DOCUMENTS 3,836,289 A * 9/1974 Wolford et al. ..... 417/417
5,395,218 A * 3/1995 Thompson ..... 417/416
6,379,125 B1 4/2002 Tojo et al.
6,644,943 B1 * 11/2003 Lilie et al. ..... 417/418
7,540,164 B2 * 6/2009 Roche et al. ..... 62/246
2003/0072658 A1 * 4/2003 Park et al. ..... 417/417
2005/0129548 A1 6/2005 Kim et al.
2006/0024181 A1 2/2006 Kim
2006/0127225 A1 6/2006 Kim et al.
2006/0171825 A1 8/2006 Choi et al.
2006/0228224 A1 10/2006 Hong et al.
2006/0288719 A1 12/2006 Shapiro et al.

FOREIGN PATENT DOCUMENTS

JP 5-223368 8/1993
JP 2006-105012 4/2006

OTHER PUBLICATIONS

English language Abstract of JP 2006-105012.
English language Abstract of JP 5-223368, Aug. 31, 1993.

* cited by examiner

*Primary Examiner*—Devon C Kramer
*Assistant Examiner*—Todd D Jacobs
(74) *Attorney, Agent, or Firm*—KED & Associates, LLP

(57) ABSTRACT

A two stage reciprocating compressor includes a casing. A first compressing unit is disposed in the casing and includes a first piston and a first cylinder, the first compressing unit being driven by a reciprocating motor to linearly reciprocate the first piston in the first cylinder to suck in and compress gas. A second compressing unit is disposed in the casing and includes a second piston and a second cylinder, the second compressing unit being driven by vibration of the first compressing unit to linearly reciprocate the second piston in the second cylinder to suck in and compress gas. A vibration transfer member transfers the vibration from the first compressing unit to the second compressing unit. The first and second compressing units extend in parallel and face in the same direction, the second compressing unit being located adjacent to a suction passage of the first compressing unit.

14 Claims, 5 Drawing Sheets

TWO STAGE RECIPROCATING COMPRESSOR AND REFRIGERATOR HAVING THE SAME

CROSS REFERENCE TO RELATED APPLICATION

The present disclosure relates to subject matter contained in priority Korean Patent Application No. 10-2007-0029856, filed on Mar. 27, 2007, and 10-2007-0057883, filed on Jun. 13, 2007 which are herein expressly incorporated by reference in its entirety.

BACKGROUND OF THE INVENTION

1. Field of the Invention

The present invention relates to a reciprocating compressor, and more particularly, to a two stage reciprocating compressor which may be provided in a refrigerator having two evaporators for efficiently performing gas suction by two compressing units by implementing one compressor having the two compressing units, and a refrigerator having the same.

2. Description of the Related Art

Generally, compressors convert electric energy into kinetic energy so as to compress a refrigerant by using the kinetic energy. The compressor is a core element of a freezing cycle system, and there are various types of compressors for compressing the refrigerant, such as a rotary compressor, a scroll compressor, a reciprocating compressor, and so on.

FIG. 1 is a cross-sectional view of a conventional reciprocating compressor. As shown, the reciprocating compressor includes a casing 100 having a gas suction pipe 110 and a discharge pipe 120, a frame unit 200 disposed in the casing 100, a reciprocating motor 300 mounted at the frame unit 200 so as to generate a linear reciprocating driving force, a compressing unit 400 compressing gas by receiving the driving force from the reciprocating motor 300, and a resonance spring unit 500 for generating resonance by using the driving force of the reciprocating motor 300.

The frame unit 200 includes a front frame 210 supporting one side of the reciprocating motor 300, a middle frame 220 supporting another side of the reciprocating motor 300, and a rear frame 230 coupled to the middle frame 220 so as to form a space with the middle frame 220.

The reciprocating motor 300 includes an outer stator 310 fixed between the middle frame 220 and the rear frame 230, an inner stator 320 inserted into the outer stator 310 so as to be fixedly-coupled to a side of the front frame 210, a mover 330 movably inserted between the outer stator 310 and the inner stator 320, and a winding coil 340 coupled to the inside of the outer stator 310. The mover 330 includes a magnet 331 and a magnet holder 332 supporting the magnet 331.

The compressing unit 400 includes a cylinder 410 fixedly-coupled to the front frame 210, a piston 420 having one side movably inserted into the cylinder 410 and another side fixedly-coupled to the mover 330, a discharge valve assembly 430 mounted at one side of the cylinder 410 so as to control the discharge of the refrigerant, and a suction valve 440 mounted at an end portion of the piston 420 so as to control a flow of the refrigerant that is sucked into an inner space of the cylinder 410.

The piston 420 includes a cylindrical body 421 which has specific length and outer diameter, a flange 422 extended from the end of the cylindrical body in a vertical direction so as to be coupled to the magnet holder 332 of the mover, and a suction passage 423 penetratingly formed in the cylindrical body 421.

The discharge valve assembly 430 includes a discharge cover 431 for covering the inner space of the cylinder 410, a discharge valve 432 inserted into the discharge cover 431 so as to open/close the inner space of the cylinder 410, and a discharge spring 433 inserted into the discharge cover 431 so as to elastically support the discharge valve 432.

The resonance spring unit 500 includes a spring support 510 fixedly-coupled with the piston 420 and the mover 330, a front coil spring 520 coupled between the spring support 510 and the middle frame 220, and a rear coil spring 530 coupled between the spring support 510 and the rear frame 230.

Reference numeral 10 denotes a support spring, and 411 denotes the inner space of the cylinder.

An operation of the reciprocating compressor will be described as follows.

When power is supplied to the reciprocating compressor, the linear reciprocating driving force is generated by an electromagnetic interaction of the reciprocating motor 300, and the linear reciprocating driving force is transferred to the piston 420 through the mover 330.

The piston 420 is linearly reciprocated in the inner space 411 of the cylinder by receiving the linear reciprocating driving force of the mover 330. By the linear reciprocating motion of the piston 420, the suction valve 440 and the discharge valve 432 are operated by a difference between a pressure of the inner space 411 and an external pressure of the cylinder. The refrigerant is sucked and compressed so as to be discharged into the inner space 411 of the cylinder. The discharged refrigerant flows outside of the compressor through the discharge cover 431 and the discharge pipe 120. This procedure is repeated so that the refrigerant is compressed.

The front coil spring 520 and the rear coil spring 530 are contracted/relaxed together with the reciprocating motion of the mover 330 and the piston 420, thereby elastically supporting the mover 330 and the piston 420 and causing the resonance.

The reciprocating compressor may be provided in a freezing cycle apparatus and the freezing cycle apparatus may be provided in a refrigerator.

Refrigerators may be a type having one evaporator (cooling unit) or another type having two evaporators.

In a refrigerator having two evaporators, i.e., a freezing chamber evaporator and a refrigerating chamber evaporator, the temperature of the freezing chamber and the refrigerating chamber is accurately controlled so that it is possible to store foods in fresh state for a long time. However, in a refrigerator having two evaporators and one compressor, the freezing chamber and the refrigerating chamber should be alternately operated. Further, in a refrigerator having two evaporators and two compressors, a large space for a machine chamber for installing the compressors is required, such that the space for storing the foods is made smaller.

Meanwhile, when the reciprocating compressor having one compressing unit is applied to a refrigerator having two evaporators, two reciprocating compressors must be mounted in the refrigerator. Accordingly, the space for the machine chamber where the compressor is installed is enlarged, and the storing space of the refrigerator is smaller.

SUMMARY OF THE INVENTION

Therefore, the present invention is directed to a two stage reciprocating compressor which is capable of being applied to a refrigerator having two evaporators and efficiently performing gas suction by two compressing units by implementing one compressor having the two compressing units, and a refrigerator having the same.

According to an aspect of the invention, a two stage reciprocating compressor includes a casing; a first compressing unit disposed in the casing and including a first piston and a first cylinder, the first compressing unit being driven by a reciprocating motor to linearly reciprocate the first piston in the first cylinder to suck in and compress gas; a second compressing unit disposed in the casing and including a second piston and a second cylinder, the second compressing unit being driven by vibration of the first compressing unit to linearly reciprocate the second piston in the second cylinder to suck in and compress gas; and a vibration transfer member that transfers the vibration from the first compressing unit to the second compressing unit. The first and second compressing units extend in parallel and face in the same direction, the second compressing unit being located adjacent to a suction passage of the first compressing unit.

The first compressing unit and the second compressing unit may move in a same direction when compressing gas. The suction passage of the first compressing unit may be formed in the first piston of the first compressing unit, and the second compressing unit may be disposed laterally of the first piston of the first compressing unit so as to accelerate the flow of gas into the suction passage of the first compressing unit by the motion of the second compressing unit.

The casing may contain gas which has been compressed and discharged from the second compressing unit, such gas being sucked into the first compressing unit. The second piston of the second compressing unit may be fixedly-coupled to the vibration transfer member so as to be located between the vibration transfer member and a sub frame, and a support frame may be coupled with the second cylinder of the second compressing unit. The vibration transfer member may include a disk portion having a through hole therein, and a connecting portion extended from one side of the disk portion.

According to another aspect of the invention, a refrigerator includes a refrigerator body; a refrigerating chamber evaporator disposed in the refrigerator body to generate and supply cool air to a refrigerating chamber; a freezing chamber evaporator disposed in the refrigerator body to generate and supply cool air to a freezing chamber; and a two stage reciprocating compressor connected to the refrigerating chamber evaporator and the freezing chamber evaporator. The two stage reciprocating compressor includes a casing; a first compressing unit disposed in the casing and including a first piston and a first cylinder, the first compressing unit being driven by a reciprocating motor to linearly reciprocate the first piston in the first cylinder to suck in and compress gas; a second compressing unit disposed in the casing and including a second piston and a second cylinder, the second compressing unit being driven by vibration of the first compressing unit to linearly reciprocate the second piston in the second cylinder to suck in and compress gas; and a vibration transfer member that transfers the vibration from the first compressing unit to the second compressing unit. The first and second compressing units extend in parallel and face in the same direction, the second compressing unit being located adjacent to a suction passage of the first compressing unit.

According to another aspect of the invention, a two stage reciprocating compressor includes a casing; a first compressing unit disposed in the casing and including a first piston and a first cylinder, the first compressing unit being driven by a reciprocating motor to linearly reciprocate the first piston in the first cylinder to suck in and compress gas; a second compressing unit disposed in the casing and including a second piston and a second cylinder, the second compressing unit being driven by vibration of the first compressing unit to linearly reciprocate the second piston in the second cylinder to suck in and compress gas; and a vibration transfer member that transfers the vibration from the first compressing unit to the second compressing unit. The second compressing unit is located adjacent to a suction passage of the first compressing unit so that motion of the second compressing unit accelerates the flow of gas into the suction passage of the first compressing unit.

The first compressing unit and the second compressing unit may move in a same direction when compressing gas. The suction passage of the first compressing unit may be formed in the first piston of the first compressing unit, and the second compressing unit may be disposed laterally of the first piston of the first compressing unit so as to accelerate the flow of gas into the suction passage of the first compressing unit by the motion of the second compressing unit.

The casing may contain gas which has been compressed and discharged from the second compressing unit, such gas being sucked into the first compressing unit. The second piston of the second compressing unit may be fixedly-coupled to the vibration transfer member so as to be located between the vibration transfer member and a sub frame, and a support frame may be coupled with the second cylinder of the second compressing unit. The vibration transfer member may include a disk portion having a through hole therein, and a connecting portion extended from one side of the disk portion.

According to another aspect of the invention, a refrigerator includes a refrigerator body; a refrigerating chamber evaporator disposed in the refrigerator body to generate and supply cool air to a refrigerating chamber; a freezing chamber evaporator disposed in the refrigerator body to generate and supply cool air to a freezing chamber; and a two stage reciprocating compressor connected to the refrigerating chamber evaporator and the freezing chamber evaporator. The two stage reciprocating compressor includes a casing; a first compressing unit disposed in the casing and including a first piston and a first cylinder, the first compressing unit being driven by a reciprocating motor to linearly reciprocate the first piston in the first cylinder to suck in and compress gas; a second compressing unit disposed in the casing and including a second piston and a second cylinder, the second compressing unit being driven by vibration of the first compressing unit to linearly reciprocate the second piston in the second cylinder to suck in and compress gas; and a vibration transfer member that transfers the vibration from the first compressing unit to the second compressing unit. The second compressing unit is located adjacent to a suction passage of the first compressing unit so that motion of the second compressing unit accelerates the flow of gas into the suction passage of the first compressing unit.

According to another aspect of the invention, a method of compressing gas with a compressor having a first compressing unit with a first piston and a first cylinder, and a second compressing unit with a second piston and a second cylinder, includes driving the first compressing unit to linearly reciprocate the first piston in the first cylinder to suck in and compress gas; transferring vibration from the first compressing unit to the second compressing unit; driving the second compressing unit by vibration of the first compressing unit to linearly reciprocate the second piston in the second cylinder to suck in and compress gas; and accelerating the flow of gas into a suction passage of the first compressing unit by motion of the second compressing unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate preferred embodiments of the invention and together with the description serve to explain the principles of the invention.

In the drawings.

DETAILED DESCRIPTION OF THE INVENTION

Description will now be given in detail of the preferred embodiments of the present invention, examples of which are illustrated in the accompanying drawings.

Figure 1:
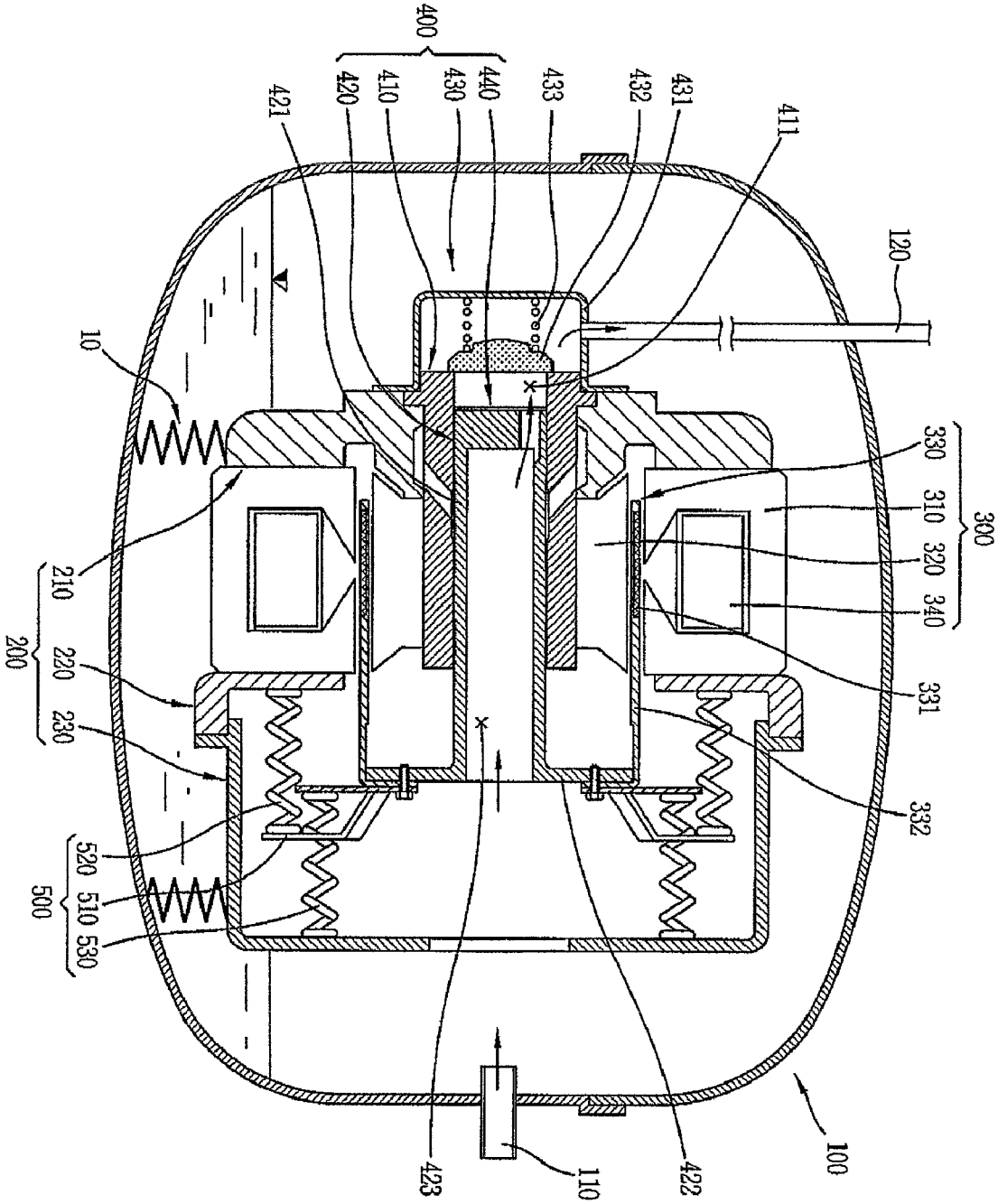
FIG. 1 PRIOR ART
FIG. 1 is a cross-sectional view of a conventional reciprocating compressor.
Figure 2:
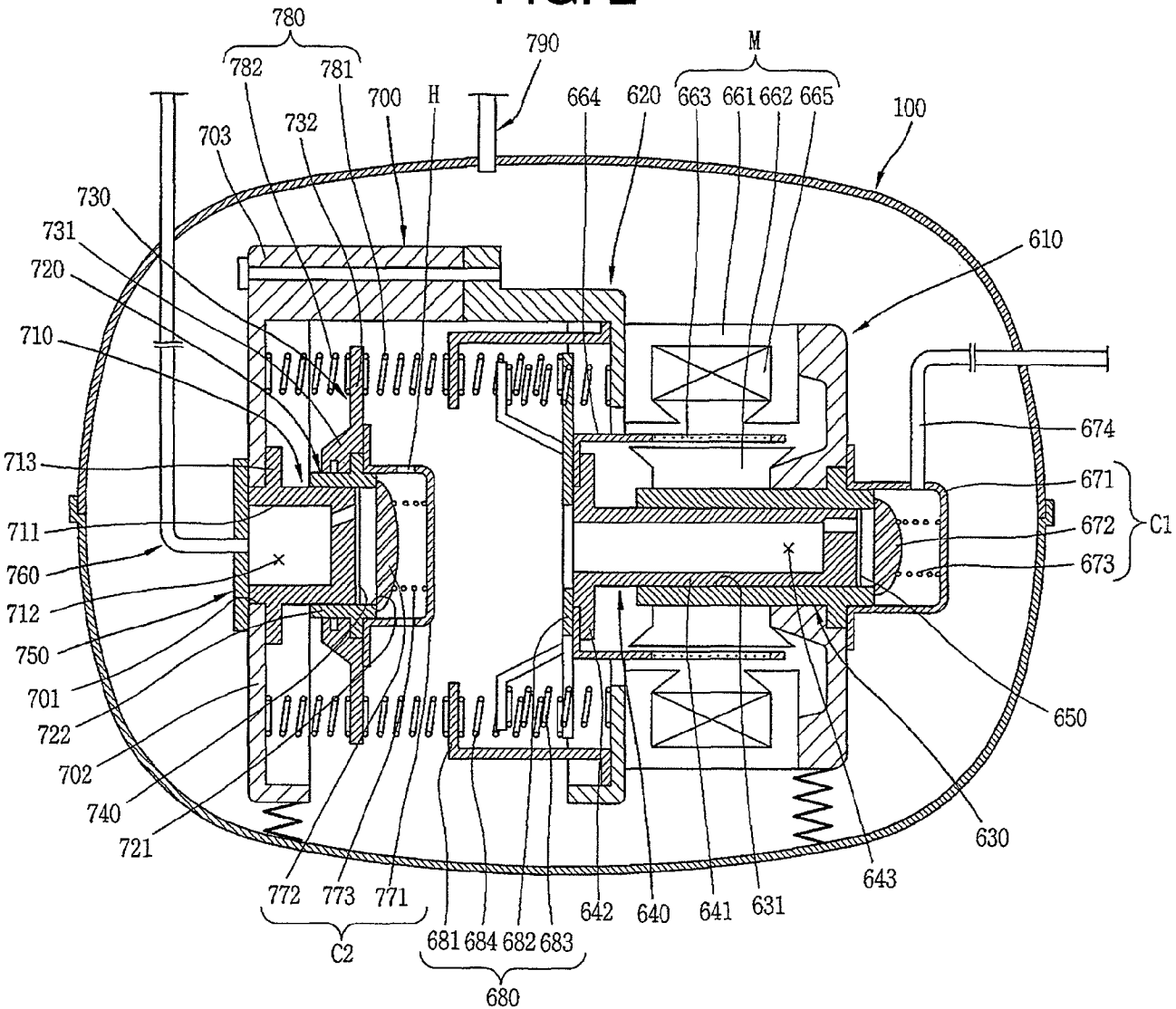
FIG. 2 is a cross-sectional view of one embodiment of a two stage reciprocating compressor in accordance with the present invention.

FIG. 2 is a cross-sectional view showing one embodiment of the two stage reciprocating compressor in accordance with the present invention.

As shown in the drawing, a first compressing unit may be disposed in the casing 100 having a certain inner space so as to suck gas and compress same by receiving a reciprocating driving force from a reciprocating motor M.

The first compressing unit may include a main frame 610 having a certain shape, a sub frame 620 spaced from the main frame 610 with a constant interval therebetween, the reciprocating motor M coupled between the main frame 610 and the sub frame 620, a first cylinder 630 penetratingly coupled to the main frame 610, a first piston 640 inserted into the first cylinder 630 to be reciprocated, a first discharge valve assembly C1 mounted at one side of the first cylinder 630 so as to control discharging of a refrigerant, and a first suction valve 650 mounted at an end portion of the first piston 640 so as to control a flow of the refrigerant sucked into an inner space of the first cylinder 630.

The first cylinder 630 may have a cylindrical shape and be provided with a cylinder hole 631 into which the first piston 640 is inserted. The first cylinder 630 may be coupled to the main frame 610 so as to be perpendicular with the main frame 610.

The first piston 640 may include a body portion 641 having a certain length and outer diameter, a flange portion 642 curvedly extended from one side of the body portion 641, and a suction passage 643 penetratingly formed in the body portion 641. The body portion 641 of the first piston 640 may be inserted into the cylinder hole 631 of the first cylinder 630.

The reciprocating motor M may include an outer stator 661 coupled between the main frame 610 and the sub frame 620, an inner stator 662 coupled to an outer circumferential surface of the first cylinder 630 spaced from the outer stator 661 with a constant interval therebetween, and a magnet 663 located between the outer stator 661 and the inner stator 662. The magnet 663 may be coupled to a magnet holder 664, and the magnet holder 664 may be coupled to the flange portion 642 of the first piston 640. A winding coil 665 may be provided at the outer stator 661. The magnet holder 664 and the magnet 663 may be referred to as a mover.

The first discharge valve assembly C1 may include a first discharge cover 671 covering one side of the first cylinder 630, a first discharge valve 672 located in the first discharge cover 671 so as to open/close the first cylinder 630, and a first valve spring 673 elastically supporting the first discharge valve 672.

A first discharge pipe 674 for discharging gas may be connected to one side of the first discharge cover 672, and be penetratingly coupled to the casing 100.

A first resonance spring unit 680 may be provided to elastically support the first piston 640. The first resonance spring unit 680 may include a spring support member 681 coupled to the sub frame 620, a spring holder 682 coupled to the flange portion 642 of the first piston 640, a front resonance spring 683 disposed between one side of the spring holder 682 and the sub frame 620, and a rear resonance spring 684 disposed between the spring holder 682 and the spring support member 681. Preferably, the front and rear resonance springs 683, 684 may be formed of a plurality of coil springs.

A vibration transfer member 700 may be coupled to the sub frame 620.

The vibration transfer member 700 may include a disk portion 702 having a certain area and provided with a through hole 701 therein and a connecting portion 703 extended from one side of the disk portion 702 in a certain length. The connecting portion 703 of the vibration transfer member 700 may be coupled to the sub frame 620, and a certain space may be formed between the vibration transfer member 700 and the sub frame 620.

A second compressing unit may be provided at the vibration transfer member 700 so as to compress gas by using vibration transferred through the vibration transfer member 700.

The second compressing unit and the first compressing unit may be positioned on the same line. Particularly, the second compressing unit may be disposed at a rear side of the first piston 640 so as to accelerate sucking of the refrigerant into the suction passage 643 that is formed in the first piston 640 of the first compressing unit by using the vibration of the second compressing unit.

The second compressing unit may include a second piston 710 fixedly-coupled to the vibration transfer member 700 so as to be located between the vibration transfer member 700 and the sub frame 620, a second cylinder 720 into which the second piston 710 is inserted, a support frame 730 coupled to the second cylinder 720, a second discharge valve assembly C2 mounted at one side of the second cylinder 720 so as to control discharging of the refrigerant, and a second suction valve 740 mounted at the end portion of the second piston 710 so as to control the flow of the refrigerant sucked into the inner space of the second cylinder 720.

The second piston 710 may include a body portion 711 having a certain outer diameter and length, a suction passage 712 penetratingly formed in the body portion 711, and a ring-shaped flange portion 713 extended from the outer circumferential surface of one side of the body portion 711 in a certain thickness and length. The end portion of one side of the body portion 711 of the second piston 710 may be inserted into the disk portion through hole 701 of the vibration transfer member 700.

A covering member 750 having a certain area may be fixedly-coupled to the disk portion 702 of the vibration transfer member 700 so as to cover one side of the suction passage 712 of the second piston 710. A through hole may be formed at the covering member 750 to be communicated with the suction passage 712 of the second piston 710. A first suction pipe 760 may be connected to the through hole and penetratingly coupled to the casing 100.

The second cylinder 720 may have the cylindrical shape having a certain length and include a cylinder body 722 in which a cylinder hole 721 is penetratingly formed therein, and a flange portion 723 formed at the outer circumferential surface of one side of the cylinder body 722.

The body portion 711 of the second piston 710 may be inserted into the cylinder hole 721 of the second cylinder 720. Since the second piston 710 is fixed to the vibration transfer member 700, the second cylinder 720 may be reciprocated. Preferably, the second piston 710 and the second cylinder 720 may be on the same line with the first piston 640 of the first compressing unit and located toward the flange portion 642 of the first piston 640.

Since the second cylinder 720 is on the same line with the first piston 640 and located toward the flange portion 642 of the first piston 640, the second cylinder 720 may be reciprocated following the second piston 710, and thereby accelerating sucking of the refrigerant into the suction passage 643 of the first piston 640 by flowing of the refrigerant.

The support frame 730 may include a body portion 731 having a coupling hole therein and a support portion 732 extended from the body portion 731. The second cylinder 720 may be coupled to the coupling hole of the support frame 730.

The second discharge valve assembly C2 may include a second discharge cover 771 covering one side of the second cylinder 720, a second discharge valve 772 disposed in the second discharge cover 771 so as to open/close the second cylinder 720, and a second valve spring 773 elastically supporting the second discharge valve 772.

Discharge holes H may be formed at one side of the second discharge cover 771 to discharge gas.

Further, a second resonance spring unit 780 may be provided to elastically support the second cylinder 720 and the support frame 730.

The second resonance spring unit 780 may include a front resonance spring 781 disposed between the spring support member 681 and the flange portion 732 of the support frame 730, and a rear resonance spring 782 disposed between the flange portion 732 of the support frame 730 and the disk portion 702 of the vibration transfer member 700.

Preferably, the front and rear resonance springs 781, 782 may be formed of a plurality of coil springs which are disposed with a constant interval therebetween.

The first and second compressing units may be supported at a lower surface of the casing 100 by an elastic support unit, such as by springs.

The lower surface of the inside of the casing 100 may be filled with a certain amount of oil.

And, a second suction pipe 790 may be coupled to one side of the casing 100 so as to suck the refrigerant into the casing 100.

Figure 3:
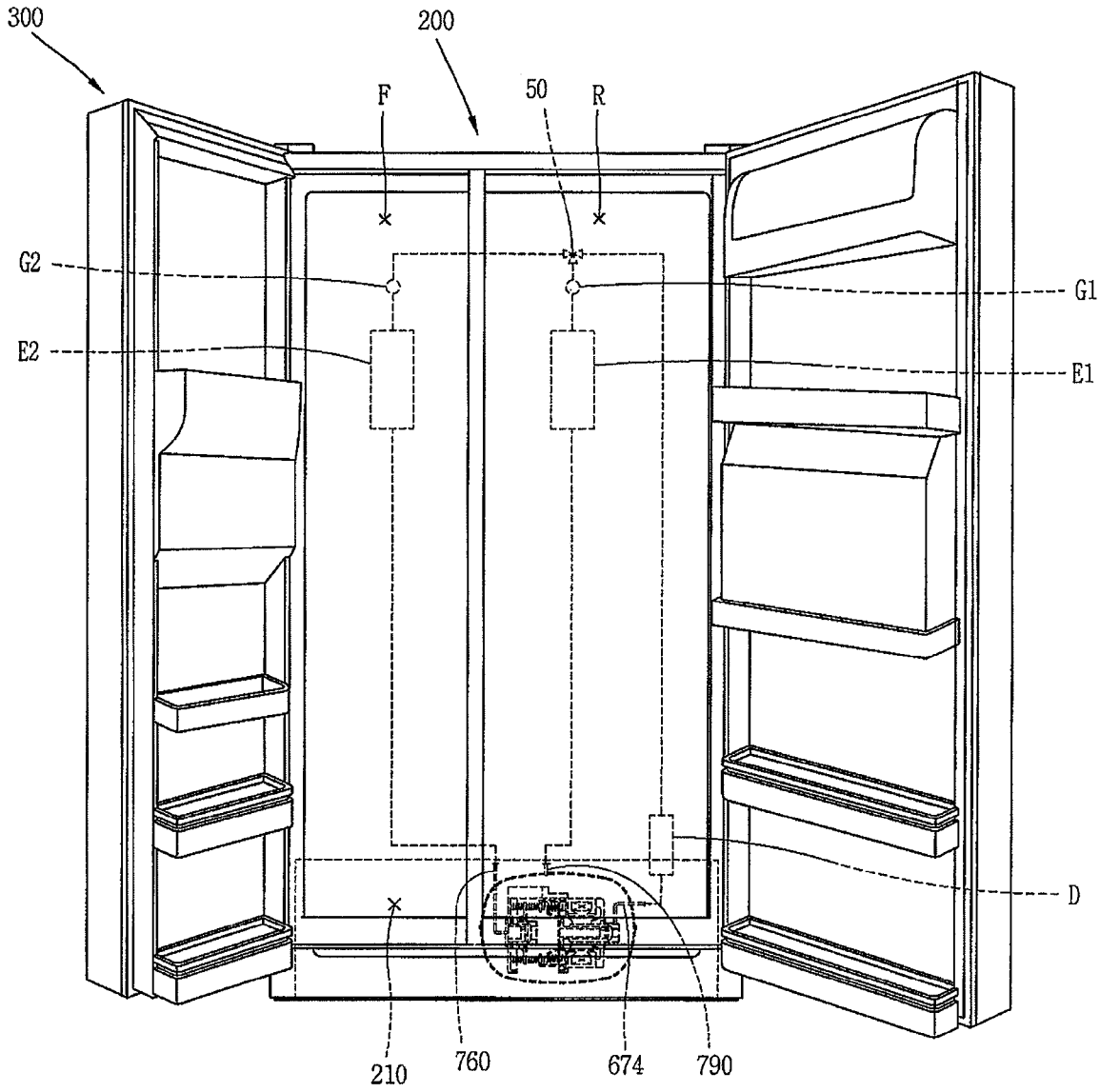
FIG. 3 is a perspective view of one embodiment of a refrigerator in accordance with the present invention.

FIG. 3 is a perspective view showing a refrigerator in accordance with the present invention.

As shown in the drawing, the refrigerator in accordance with the present invention may include a refrigerator body 200 provided with a refrigerating chamber R and a freezing chamber F, a refrigerating chamber evaporator E1 mounted at the refrigerating body 200 so as to generate cool air to be supplied to the refrigerating chamber R, and a freezing chamber evaporator E2 mounted at the refrigerator body 200 so as to generate cool air to be supplied to the freezing chamber F, the two stage reciprocating compressor connected to the refrigerating chamber evaporator E1 and the freezing chamber evaporator E2, a condenser D connected to the two reciprocating compressor so that the refrigerant discharged therefrom may be condensed and supplied to the refrigerating chamber evaporator E1 and the freezing chamber evaporator E2, a first expanding unit G1 for expanding the refrigerant flown into the refrigerating chamber evaporator E1, and a second expanding unit G2 for expanding the refrigerant flown into the freezing chamber evaporator E2.

The two stage reciprocating compressor is as described above.

The discharge pipe 674 of the two stage reciprocating compressor may be connected to the condenser D. The first suction pipe 760 may be connected to the freezing chamber evaporator E2 disposed at the side of the freezing chamber and the second suction pipe 790 may be connected to the refrigerating chamber evaporator E1 disposed at the side of the refrigerating chamber.

Reference numeral 210 denotes a machine chamber, and 300 denotes a door.

Hereafter, the operations of the two stage reciprocating compressor and the refrigerator having the same will be described.

Figure 4:
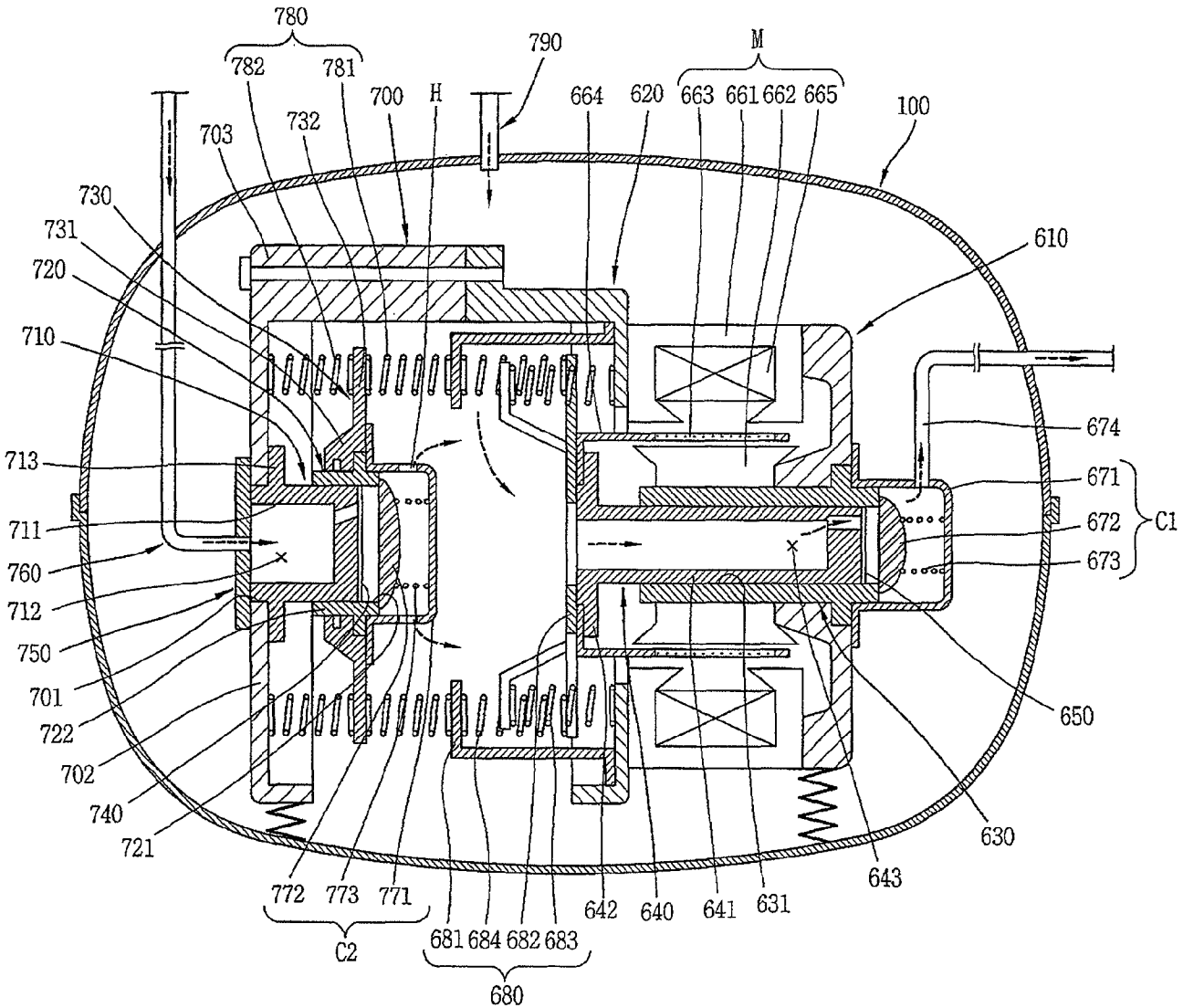
FIG. 4 is a cross-sectional view showing an operation state of the two reciprocating compressor of FIG. 2.

First, when a power supplied to the two stage reciprocating compressor is applied to the reciprocating motor M, the mover may be linearly reciprocated by an interaction between flux formed by an electric current flowing the winding coil 665 and the flux of the magnet 663. By the linear reciprocating motion of the mover, as shown in FIG. 4, the first piston 640 connected to the mover may be linearly reciprocated in the first cylinder 630.

The mover and the first piston 640 may be supported by an elastic force of the first resonance spring unit 680 so as to generate the resonance.

As the first piston 640 is linearly reciprocated in the first cylinder 630, the first suction valve 650 and the first discharge valve 672 may be operated by a difference between internal pressure and external pressure of the first cylinder 630. Accordingly the refrigerant filled in the casing 100 may be sucked into the first cylinder 630 through the suction passage 643 of the first piston 640 and the sucked refrigerant may be compressed, thereby being discharged in a pre-set pressurized state.

The refrigerant having high temperature and pressure which has been discharged from the first cylinder 630 may be flowed outside of the casing 100 through the first discharge cover 671 and the discharge pipe 674.

At the same time, the mover of the first compressing unit and the first piston 640 may be reciprocated, accordingly sucking the refrigerant and compressing same. The refrigerant may be discharged, and vibration may be generated. The vibration may be transferred to the second compressing unit by the vibration transfer member 700.

As the vibration generated from the first compressing unit is transferred to the second compressing unit through the vibration transfer member 700, the second cylinder 720 elastically supported by the second resonance spring unit 780 and the support frame 730 may be reciprocated by the vibration transferred to the second compressing unit. The second cylinder 720 may be reciprocated along the second piston 710, and the second resonance spring unit 780 may cause the resonance of the second cylinder 720 and the support frame 730.

By the reciprocating motion of the second cylinder 720, the second suction valve 740 and the second discharge valve 772 may be operated by the difference between the internal pressure and the external pressure of the second cylinder 720. Accordingly the refrigerant may be sucked into the second cylinder 720 through the first suction pipe 760 and the suction passage 712 of the second piston 710, and the sucked refrigerant may be compressed, thereby being discharged in the pre-set pressurized state. The discharged refrigerant may be flowed into the casing 100 through the discharge holes H of the second discharge cover 771.

Figure 5:
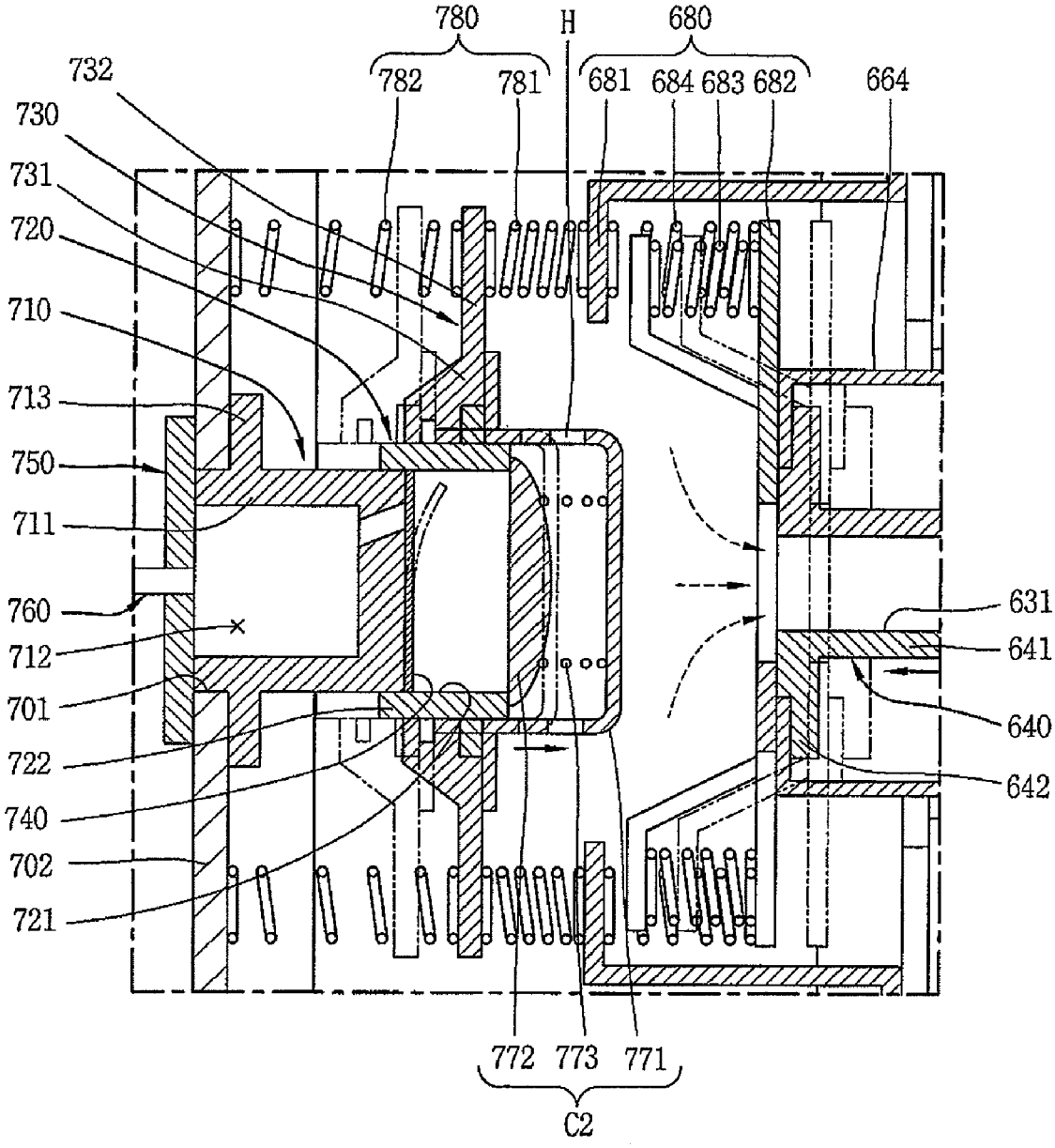
FIG. 5 is a cross-sectional view showing gas suction in the two stage reciprocating compressor of FIG. 2.

As the second cylinder 720 and the support frame 730 which are coupled to each other are reciprocated laterally of the first piston 640, as shown in FIG. 5, flowing of the refrigerant may be generated, thereby accelerating suction of the refrigerant into the suction passage 643 of the first piston 640.

Meanwhile, when the first suction pipe 760 is connected to the evaporator disposed at the side of the freezing chamber of the refrigerator, and the second suction pipe 790 is connected to the evaporator disposed at the side of the refrigerating chamber of the refrigerator, the refrigerant having passed through the freezing chamber evaporator may be compressed at the second compressing unit through the first suction pipe 760 so that the refrigerant may be discharged into the casing 100, and the refrigerant having passed through the refrigerating chamber may be sucked into the casing 100 through the second suction pipe 790.

The refrigerants which are discharged from the second compressing unit and sucked into the casing 100 through the second suction pipe 790, respectively, may be sucked into the first compressing unit so as to be compressed and discharged. The discharged refrigerant which has high temperature and pressure may be flowed toward the evaporator through the discharge pipe 674.

A compressing ratio of the first compressing unit and the second compressing unit can be variable according to an operation voltage and an operation frequency.

As such, in accordance with the present invention, the first and second compressing units which respectively perform the compression of gas are disposed in the casing 100 on the same line. Accordingly interference therebetween can be minimized, enabling an overall structure to be compact. Also, the motion of the second compact unit accelerates gas suction of the first compressing unit, thereby enabling the gas suction efficiency of the first compressing unit to be enhanced.

Further, in accordance with the present invention, when applied to the refrigerator having the evaporators disposed in the freezing chamber and the refrigerating chamber, respectively, the freezing chamber and the refrigerating chamber can be consecutively operated by using one compressor.

The two stage reciprocating compressor in accordance with the present invention, by being implemented as a compressor having two compressing units and compact structure, minimizes the space for the refrigerator machine chamber when applied to the refrigerator having two evaporators, and enhances gas suction efficiency by accelerating the gas suction, thereby enabling the performance of the compressor to be improved.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present inventive features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A two stage reciprocating compressor comprising:

a casing;

a first compressing unit disposed in the casing and including a first piston and a first cylinder, the first compressing unit being driven by a reciprocating motor to linearly reciprocate the first piston in the first cylinder to suck in and compress gas;

a second compressing unit disposed in the casing and including a second piston and a second cylinder, the second compressing unit being driven by vibration of the first compressing unit to linearly reciprocate the second piston in the second cylinder to suck in and compress gas; and a vibration transfer member that transfers the vibration from the first compressing unit to the second compressing unit, wherein the first and second compressing units extend in parallel and face in the same direction, the second compressing unit being located adjacent to a suction passage of the first compressing unit.

2. The compressor of claim 1, wherein the first compressing unit and the second compressing unit move in a same direction when compressing gas.

3. The compressor of claim 1, wherein the suction passage of the first compressing unit is formed in the first piston of the first compressing unit, and the second compressing unit is disposed laterally of the first piston of the first compressing unit so as to accelerate the flow of gas into the suction passage of the first compressing unit by the motion of the second compressing unit.

4. The compressor of claim 1, wherein the casing contains gas which has been compressed and discharged from the second compressing unit, such gas being sucked into the first compressing unit.

5. The compressor of claim 1, wherein the second piston of the second compressing unit is fixedly-coupled to the vibration transfer member so as to be located between the vibration transfer member and a sub frame, and a support frame is coupled with the second cylinder of the second compressing unit.

6. The compressor of claim 1, wherein the vibration transfer member comprises a disk portion having a through hole therein, and a connecting portion extended from one side of the disk portion.

7. A refrigerator comprising:

a refrigerator body;

a refrigerating chamber evaporator disposed in the refrigerator body to generate and supply cool air to a refrigerating chamber;

a freezing chamber evaporator disposed in the refrigerator body to generate and supply cool air to a freezing chamber; and a two stage reciprocating compressor connected to the refrigerating chamber evaporator and the freezing chamber evaporator, the two stage reciprocating compressor comprising:

a casing;

a first compressing unit disposed in the casing and including a first piston and a first cylinder, the first compressing unit being driven by a reciprocating motor to linearly reciprocate the first piston in the first cylinder to suck in and compress gas;

a second compressing unit disposed in the casing and including a second piston and a second cylinder, the second compressing unit being driven by vibration of the first compressing unit to linearly reciprocate the second piston in the second cylinder to suck in and compress gas; and a vibration transfer member that transfers the vibration from the first compressing unit to the second compressing unit, wherein the first and second compressing units extend in parallel and face in the same direction, the second compressing unit being located adjacent to a suction passage of the first compressing unit.

8. A two stage reciprocating compressor comprising:

a casing;

a first compressing unit disposed in the casing and including a first piston and a first cylinder, the first compressing unit being driven by a reciprocating motor to linearly reciprocate the first piston in the first cylinder to suck in and compress gas;

a second compressing unit disposed in the casing and including a second piston and a second cylinder, the second compressing unit being driven by vibration of the first compressing unit to linearly reciprocate the second piston in the second cylinder to suck in and compress gas; and a vibration transfer member that transfers the vibration from the first compressing unit to the second compressing unit, wherein the second compressing unit is located adjacent to a suction passage of the first compressing unit so that motion of the second compressing unit accelerates the flow of gas into the suction passage of the first compressing unit.

9. The compressor of claim 8, wherein the first compressing unit and the second compressing unit move in a same direction when compressing gas.

10. The compressor of claim 8, wherein the suction passage of the first compressing unit is formed in the first piston of the first compressing unit, and the second compressing unit is disposed laterally of the first piston of the first compressing unit so as to accelerate the flow of gas into the suction passage of the first compressing unit by the motion of the second compressing unit.

11. The compressor of claim 8, wherein the casing contains gas which has been compressed and discharged from the second compressing unit, such gas being sucked into the first compressing unit.

12. The compressor of claim 8, wherein the second piston of the second compressing unit is fixedly-coupled to the vibration transfer member so as to be located between the vibration transfer member and a sub frame, and a support frame is coupled with the second cylinder of the second compressing unit.

13. The compressor of claim 8, wherein the vibration transfer member comprises a disk portion having a through hole therein, and a connecting portion extended from one side of the disk portion.

14. A refrigerator comprising:

a refrigerator body;

a refrigerating chamber evaporator disposed in the refrigerator body to generate and supply cool air to a refrigerating chamber;

a freezing chamber evaporator disposed in the refrigerator body to generate and supply cool air to a freezing chamber; and a two stage reciprocating compressor connected to the refrigerating chamber evaporator and the freezing chamber evaporator, the two stage reciprocating compressor comprising:

a casing;

a first compressing unit disposed in the casing and including a first piston and a first cylinder, the first compressing unit being driven by a reciprocating motor to linearly reciprocate the first piston in the first cylinder to suck in and compress gas;

a second compressing unit disposed in the casing and including a second piston and a second cylinder, the second compressing unit being driven by vibration of the first compressing unit to linearly reciprocate the second piston in the second cylinder to suck in and compress gas; and a vibration transfer member that transfers the vibration from the first compressing unit to the second compressing unit, wherein the second compressing unit is located adjacent to a suction passage of the first compressing unit so that motion of the second compressing unit accelerates the flow of gas into the suction passage of the first compressing unit.

* * * * *